US006007115A

United States Patent [19]

Roth

[11] Patent Number: 6,007,115

[45] Date of Patent: Dec. 28, 1999

[54] DOOR LOCK ASSEMBLY

[76] Inventor: Francis A. Roth, 10945 W. 66th Ave., Arvada, Colo. 80004

[21] Appl. No.: 09/196,398

[22] Filed: Nov. 19, 1998

[51] Int. Cl.[6] ..... E05C 5/00

[52] U.S. Cl. ..... 292/71; 292/63

[58] Field of Search ..... 292/2, 71, 242, 292/DIG. 44, 63, 194, 219, 198

[56] References Cited

U.S. PATENT DOCUMENTS

| | | | |
|---|---|---|---|
| 1,071,862 | 9/1913 | Becker | 292/2 |
| 1,220,210 | 3/1917 | Epling | 292/71 |
| 1,600,528 | 9/1926 | Anstey | 292/71 |
| 2,814,194 | 11/1957 | North et al. | 292/169.13 |
| 2,834,194 | 5/1958 | Schlage et al. | 292/169.13 |
| 3,144,266 | 8/1964 | Schmid et al. | 292/169.13 |
| 3,799,591 | 3/1974 | Taniyama | 292/71 |
| 3,890,813 | 6/1975 | Cothron | 292/198 |
| 4,056,276 | 11/1977 | Jarvis | 292/201 |
| 4,056,277 | 11/1977 | Gamus et al. | 292/341 |
| 4,073,518 | 2/1978 | Goodwin | 292/144 |
| 4,099,752 | 7/1978 | Geringer | 292/144 |
| 4,107,066 | 8/1978 | Schlage | 70/364 |
| 4,135,746 | 1/1979 | Sterling | 292/71 |
| 4,211,443 | 7/1980 | Butts et al. | 292/341 |
| 4,212,489 | 7/1980 | Snyder | 292/33 |
| 4,355,830 | 10/1982 | Rau, III | 292/144 |
| 4,679,834 | 7/1987 | Gotanda | 292/169 |
| 4,718,706 | 1/1988 | Fang | 292/169.13 |
| 4,729,585 | 3/1988 | Lin | 292/337 |
| 4,838,587 | 6/1989 | Choi | 292/216 |
| 4,919,464 | 4/1990 | Richards | 292/251 |
| 4,929,003 | 5/1990 | McConnell | 292/144 |
| 4,984,835 | 1/1991 | Vadacchino et al. | 292/341 |
| 5,024,472 | 6/1991 | Cohrs | 292/182 |
| 5,029,912 | 7/1991 | Gotanda | 292/143 |
| 5,076,623 | 12/1991 | Richards | 292/251 |
| 5,076,625 | 12/1991 | Oxley | 292/341 |
| 5,083,448 | 1/1992 | Karkkainen et al. | 70/277 |
| 5,100,184 | 3/1992 | Schmitt | 292/144 |
| 5,188,405 | 2/1993 | Maccaferri | 292/204 |
| 5,221,115 | 6/1993 | Takimoto | 292/29 |
| 5,474,342 | 12/1995 | Smith et al. | 292/254 |
| 5,511,839 | 4/1996 | Fuss et al. | 292/341 |
| 5,611,581 | 3/1997 | Ghostley | 292/169.13 |

FOREIGN PATENT DOCUMENTS

| | | | |
|---|---|---|---|
| 437680 | 11/1935 | United Kingdom | 292/71 |

*Primary Examiner*—Teri Pham

*Attorney, Agent, or Firm*—Cook, Alex, McFarron, Manzo, Cummings & Mehler, Ltd.

[57] ABSTRACT

A door lock assembly comprising a housing that is received in a mortise in the door with a bolt that is retractable into the housing to permit opening of the door and extendable from the housing to secure the door in its closed position. The bolt has a first portion received within the housing. A second portion is pivotally attached to the first portion so that the second portion can pivot with respect to the first portion when the bolt is extended from the housing, thus permitting opening of the door without the use of a key or rotation of a doorknob. A latch mounted within the opening of a door frame is selectively moveable from a first position engaging the second portion of the bolt when the door is closed in order to prevent the second portion of the bolt from pivoting with respect to the first portion, thus locking the door in the closed condition. When the latch is moved to its second position the second portion of the bolt can pivot with respect to the first portion to allow the door to be opened.

11 Claims, 2 Drawing Sheets

DOOR LOCK ASSEMBLY

The present invention relates to a door lock assembly and, more specifically, a remotely actuable door lock assembly which permits keyless entry.

BACKGROUND OF THE INVENTION

Remotely actuable door lock assemblies are wide-spread and commonly found in multi-family dwellings, such as apartments, where the occupant may have difficulty getting to the door in a timely manner after the door bell has sounded to manually unlock and open the door to admit a visitor. Such systems usually include a remotely-located keypad within the individual apartment and a receiver/power supply for actuating a solenoid or the like to selectively lock and/or unlock the door.

Retrofitting a door with a door knob and lock assembly that can be remotely actuated is often a difficult task requiring reconfiguring the mortises that receive the bolt assembly and the doorknobs. This task is often complicated by the need to achieve relatively precise dimensional relationships between the solenoid assembly held in the door jamb and the bolt portion held within the door.

Accordingly, it is an object of the present invention to provide a door lock assembly which can be retrofitted into an existing door without significant modification.

It is a further object to provide a remotely actuable door bolt assembly that is not overly dimensionally sensitive.

It is a still further object to provide such a remotely actuable door bolt assembly that can be overridden by the manual operation of a key.

These objects, as well as others that will become apparent upon reference to the drawings and detailed description, are provided by a lock assembly that includes a housing that is to be received in a mortise in the door. The housing holds a bolt that is retractable into the housing to permit the opening of the door and extendable from housing to secure the door in its closed position. The bolt has a first portion received within the housing and a second portion pivotally attached to the first portion so that second portion can pivot with respect to the first portion when the bolt is extended from the housing to permit the opening of the door without the use of a key or rotation of a doorknob. A latch is mounted within the opening of the door frame, the latch being selectively moveable from a first position engaging the second portion of the bolt when the door is closed in order to prevent the second portion of the bolt from pivoting with respect to the first portion, and thus lock the door in a closed condition, to a second position permitting the second portion of the bolt to pivot with respect to the first portion to allow the door to be opened.

DETAILED DESCRIPTION

Figure 1:
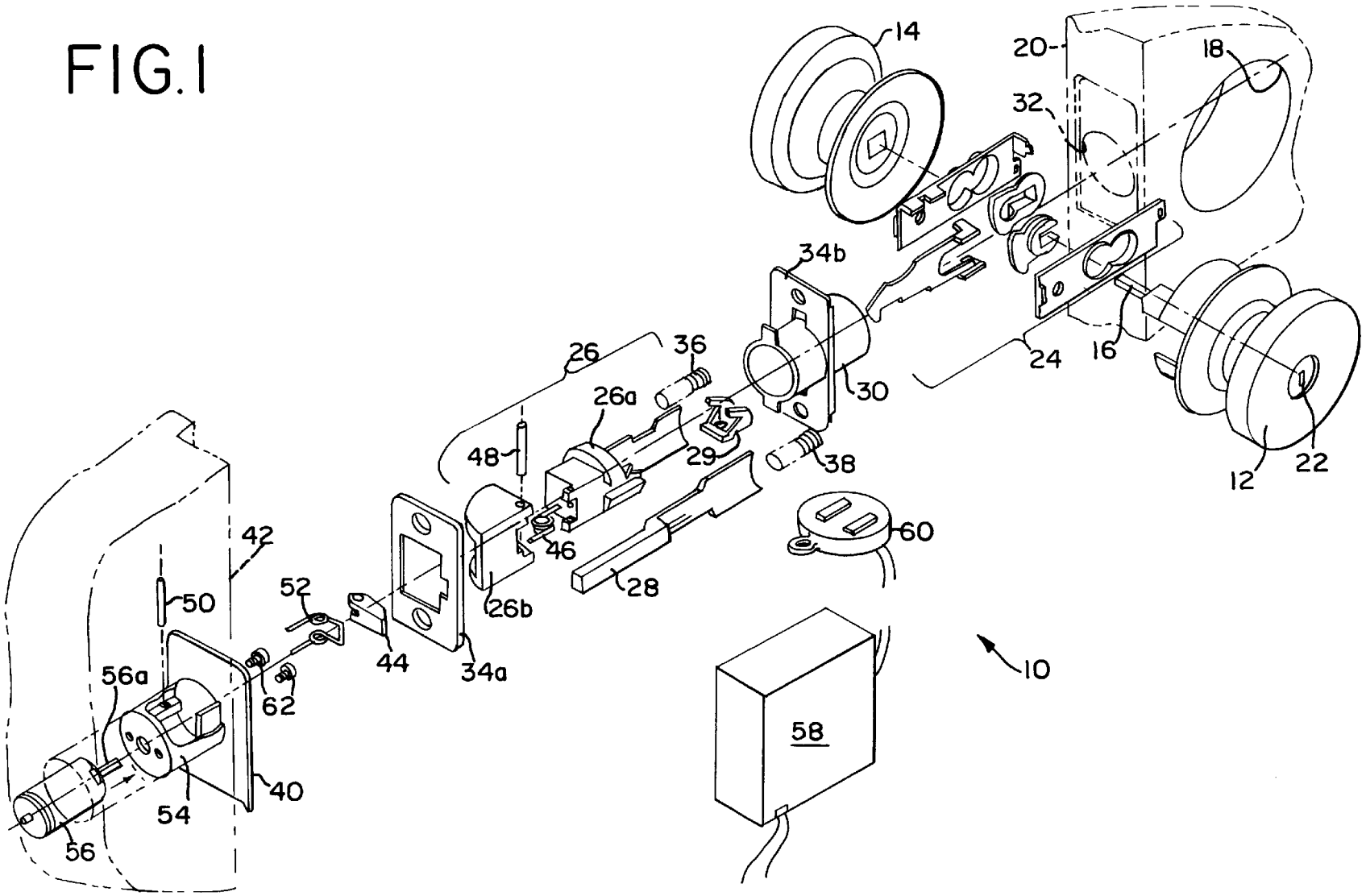
FIG. 1 is an exploded perspective view of a lock assembly according to the present invention.

Turning to the figures of the drawings, there is seen in FIG. 1 an exploded perspective view of a door lock assembly, generally indicated by 10, embodying the present invention. The door lock assembly 10 includes an exterior doorknob 12 and an interior doorknob 14 that are operatively connected to each other by a spindle 16 that extends through a hole 18 in the door 20. A standard lock mechanism (not shown) is associated with the doorknobs to prevent rotation of the exterior doorknob 12 when locked. The exterior doorknob 12 includes a keyhole 22 to allow for locking and unlocking the door with a key (also not shown) in the well-known manner. The spindle 16 is captured in a multi-part actuator and housing, collectively indicated by 24, which is operatively connected to the main bolt 26 of the lock assembly to retract the main bolt upon rotation of either the doorknobs 12 or 14, in conjunction with the use of an appropriate key received in the keyhole 22 (if the door is locked), as is well known in the art. The main bolt is cooperatively associated with a dead bolt 28, which is retractable in unison with the main bolt upon rotation of the doorknobs. If the dead bolt 28 is maintained in its retracted position (such as when the door 20 is closed), the dead bolt 28 actuates a lock tooth 29 to prevent the retraction of the main bolt 26 without turning the doorknobs.

The lock assembly 10 includes a shell or housing 30 received within a mortise or latch hole 32 in the door 20. The shell 30 is maintained within the latch hole 32 by means of a latch plate 34*a,* a mating latch plate keeper 34*b,* and two screws (not shown), as is typical in presently-available lock sets.

A main bolt 26 and dead bolt 28 are biased outwardly from the shell 30 by means of springs 36 and 38, respectively. The main bolt 26 is retractable into the housing 30 to disengage an opening in a striker plate 40 mounted to the door jamb or frame member 42 adjacent to the doorknobs 12, 14 to permit opening of the door 20, and is extendable from the housing 30 so as to be captured by the opening in the striker plate 40 to secure the door 20 in its closed position. The opening in the striker plate 40 is configured so that it maintains the dead bolt 28 in its retracted position when the door 20 is closed, thus allowing opening of the door 20 only by turning one of the doorknobs 12, 14. As thus far described, the lock assembly is similar to presently-available lock assemblies in its general structure and operation.

In keeping with the invention, the main bolt 26 includes a first portion 26*a* that is received within the housing 30 and a second portion 26*b* pivotally attached to the first portion 26*a* so that the second portion 26*b* can pivot out of engagement with the opening in the striker plate 40 when the bolt 26 is extended from the housing 30. The second portion 26*b* has the same curved shape as the end of a standard main bolt, but is also configured so that it can fold back onto the first portion 26*a* as the door is opened. As illustrated, the hinged portion 26*b* has a U-shaped cut-out that is sized so that the end of the first portion 26*a* can fit within the "U". Thus, the hinged portion 26*b* of the main bolt 26 is spring-biased to its extended position, but can be pivoted back onto the first portion 26*a* of the main bolt 26, leaving the main bolt 26, as a whole, flush with the edge of the door 20 to permit opening of the door 20 without requiring that the main bolt 26 be retracted into the housing 30 by means of either the doorknobs, 12, 14, thus permitting "keyless entry".

To this end, a latch 44 is mounted in the door jamb 42 adjacent the opening in the striker plate 40. The latch 44 is selectively moveable from a first position, in which the latch 44 engages the second portion 26*b* of the main bolt 26, to a second position in which the latch 44 disengages the second portion 26*b* of the main bolt 26. When in its first position, the latch 44 acts to prevent the second portion 26*b* from pivoting with respect to the first portion 26*a* (best seen in FIGS. 2 and 3), thus securing the door 20 in its closed position. When in its second position, the latch 44 permits the second portion 26*b* of the main bolt 26 to pivot with respect to the first portion 26*a,* thus allowing the door 20 to be opened without manipulation of either the doorknobs 12, 14 or the use of a key, but by merely pushing on the door in the opening direction.

In practice, the second, or hinged, portion 26*b* of the main bolt 26 is biased toward its first, extended position by means of a spring 46. The spring includes a coil portion that encircles a pin 48 that pivotally secures the second portion 26*b* to the first portion 26*a*.

The latch 44 is also pivotally mounted by means of a pin 50 and is biased by means of a coil spring 52 so that the latch 44 will engage the hinged portion 26*b* of the main bolt 26 when the hinged portion 26*b* extends into the hole in the striker plate 40 upon the closing of the door 20. As shown in FIG. 1., the striker plate 40 is formed with an integral cylindrical housing 54 to which the latch 44 is mounted.

Figure 2:
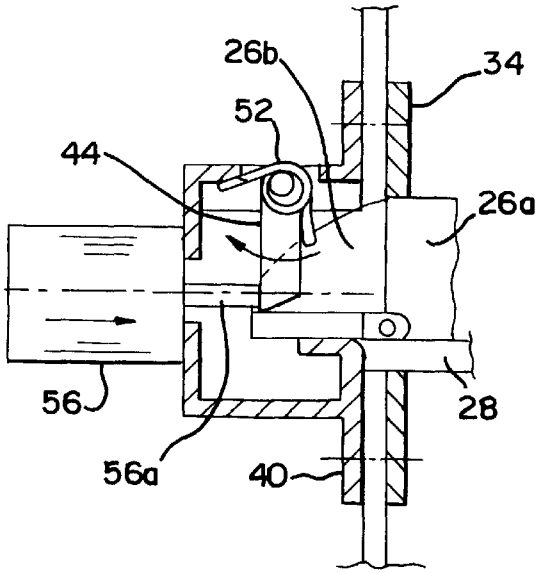
FIG. 2 is a plan view of a portion the main bolt and latch mechanism for the lock assembly of FIG. 1.

In keeping with another aspect of the invention, the latch 44 can be remotely actuated to disengage the hinged portion 26*b* of the main bolt 26 to allow keyless entry through the door 20. To this end, the lock assembly includes a plunger-type solenoid 56, and a power supply/receiver 58 therefore, which are controlled by a remotely-positioned keypad 60, all of which are commonly available. The solenoid 56 may be conveniently attached to the cylindrical housing 54 integral with the striker plate 40 by means of screws 62 so that the shaft 56*a* of the solenoid 56 extends into the housing 54 and forces the latch 44 into engagement with the hinged portion 26*b* of the main bolt 36 against the force of the spring 52. As best seen in FIG. 2, when the solenoid 56 is activated by means of the keypad 60, the shaft 56*a* will retract to allow the spring 52 to move the latch 44 out of engagement with the hinged portion 26*b* of the main bolt 26, thus allowing keyless entry through the door 20. It should be appreciated that even though the latch 44 can be remotely actuated, such actuation is not required to unlock the door, as the lock assembly 10 can be operated in the standard manner by the use of the key.

Figure 4:
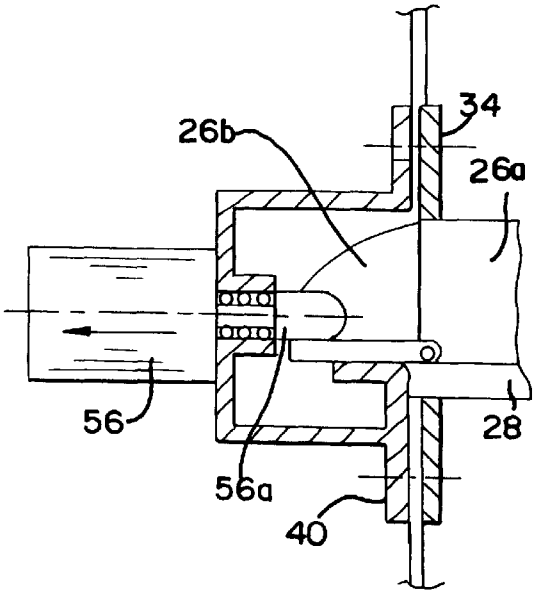
FIGS. 3 and 4 are alternate embodiments for the portion of the lock assembly shown in FIG. 2.
Figure 3:
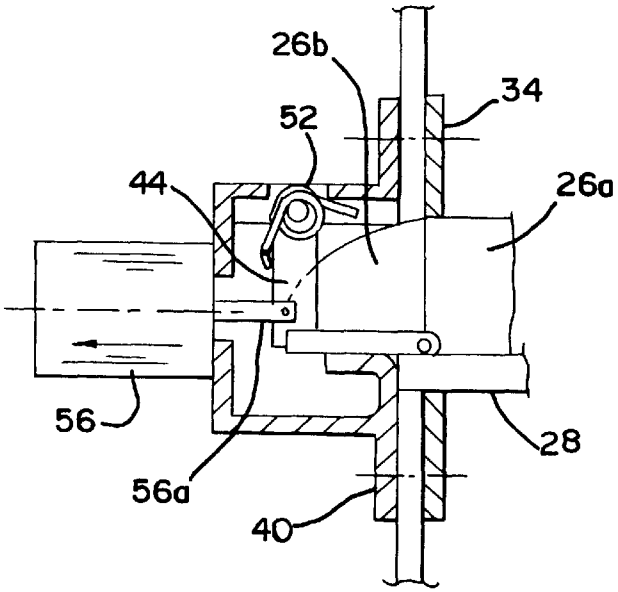

In an alternative embodiment, the latch 44 can be biased by the spring 52 into engagement with the hinged portion 26*b* of the main bolt 26 and the solenoid shaft 56*a* pulls the latch 44 out of engagement with the hinged portion 26*b* against the force of the spring 52 (as shown in FIG. 3). In a further alternative, the solenoid shaft 56*a* is substituted for the latch 44 and spring 52, and directly engages the hinged portion 26*b* of the main bolt 26 (as seen in FIG. 4). Thus, the separate latch 44 and spring 52 can be eliminated altogether.

Thus it can be seen that a lock assembly fully meeting the objects of the present invention has been provided. Because the modified, 2-piece main bolt retains the same general overall shape as prior main bolts, it can merely be substituted in existing lock mechanisms. Thus, redrilling of the door to retrofit it to receive the inventive lock assembly is not required. Further, because of the simple interaction between the remotely actuated latch and the second, hinged portion of the main bolt, precise dimensional relationships between the various components of the lock assembly are not required.

While the lock assembly has been described in terms of the illustrated embodiments, modifications should be apparent to those skilled in the art without departing from the invention. For example, any variety of push-button or remote electronic devices can be used to release the latch 44, such as rotary solenoids, as well as mechanical actuators. Further, the cooperating portions of the main bolt that permit the hinged portion to fold back onto the first portion can be of many different complementary shapes. For example, the first portion could be relieved to form a clevis that holds the hinged portion and into which the hinged portion can retract.

That which is claimed:

1. A lock assembly for a door secured by hinges to a frame comprising:

a housing adapted to be received in a mortise in the door;

a main bolt retractable into the housing to permit opening the door and adapted to extend from the housing into an opening in the frame to secure the door in a closed position, the main bolt having a first portion received within the housing and a second portion pivotally attached to the first portion so that the second portion can pivot with respect to the first portion when the main bolt is extended from the housing, the second portion being moveable from an extended position to a retracted position, the second portion further being biased into its extended position and one of the first portion and second portion having a cut-out and the other having a complementary shape so as to permit the second portion to fold back onto the first portion when retracted to permit opening of the door;

a doorknob for selectively retracting the bolt into the housing; and a latch adapted to be mounted within the opening in the frame selectively moveable from a first position engaging the second portion of the main bolt to prevent the second portion of the main bolt from pivoting with respect to the first portion to secure the door in a closed condition, to a second position permitting the second portion of the main bolt to pivot with respect to the first portion to allow the door to be opened.

2. The lock assembly of claim 1 in which the latch comprises a remotely-activated solenoid having a shaft that is selectively engageable with the second portion of the main bolt.

3. The lock assembly of claim 1 further comprising a remotely-activated solenoid associated with the latch to disengage the latch from the second portion of the main bolt to permit the second portion of the bolt to pivot to permit opening of the door.

4. The lock assembly of claim 3 further comprising a spring, the spring biasing the latch into engagement with the second portion of the bolt and the solenoid operating to pull the latch out of engagement against the force of the spring.

5. The lock assembly of claim 3 in which the latch is biased by a spring out of engagement with the second portion of the bolt and the solenoid maintains the latch in engagement with the second portion of the bolt until the solenoid is actuated.

6. A door lock assembly for a door secured by hinges to a frame comprising:

a housing adapted to be received within a mortise in the door;

a doorknob;

a main bolt moveable by manipulation of the doorknob between a first position extending from the mortise to prevent opening of the door and a second position retracted within the mortise to permit opening of the door, the main bolt further comprising a first portion received substantially within the housing and a second portion pivotally attached to the first portion and extending out from the housing, the second portion being moveable between a first position axially extending from the first portion and a second position retracted back onto the first portion, the second portion being biased into its first position and one of the first portion and second portion having a cut-out and the other having a complementary shape so as to permit the second portion to fold back onto the first portion when in its second position to permit opening of the door;

a dead bolt moveable between a first position retracted within the mortise and a second position extending from the mortise, the dead bold preventing movement of the main bolt from its first, extended position to its second, retracted position when the dead bolt is in its first, retracted position;

a striker plate adapted to be secured to the frame for deflecting and capturing the second portion of the main bolt when it is in its first extended position and for maintaining the dead bolt in its second, retracted position when the door is closed, the striker plate having an opening sized to receive the extended second portion of the main bolt, the opening adapted to overly a recess in the frame for receiving the second portion of the main bolt; and a latch adapted to be mounted within the recess in the frame, the latch being selectively moveable from a first position engaging the second portion of the main bolt to prevent the second portion of the main bolt from pivoting with respect to the first portion of the main bolt and to lock the door in a closed condition, and a second position permitting the second portion of the main bolt to pivot with respect to the first portion of the main bolt and to thus allow the door to be opened without manipulation of the doorknob to retract the main bolt.

7. The door lock assembly of claim 6 in which the latch comprises a remotely-activated solenoid having a shaft that is selectively engageable with the second portion of the main bolt.

8. The door lock assembly of claim 6 further comprising a remotely-activated solenoid associated with the latch to disengage the latch from the second portion of the main bolt to permit the second portion of the bolt to pivot to permit opening of the door.

9. The door lock assembly of claim 8 further comprising a spring, the spring biasing the latch into engagement with the second portion of the bolt and the solenoid operating to pull the latch out of engagement against the force of the spring.

10. The door lock assembly of claim 8 in which the latch is biased by a spring out of engagement with the second portion of the bolt and the solenoid maintains the latch in engagement with the second portion of the bolt until the solenoid is actuated.

11. A method of permitting the opening of a closed and bolted door mounted within a frame, said door having a lock assembly with a main bolt that is retracted into the door by manipulation of a doorknob to permit opening of the door without the manipulation of the doorknob comprising:

providing the lock assembly adapted to be received in a mortise in the door wherein the main bolt comprises a first portion received within the door and a second portion received within the frame and pivotally attached to the first portion so as to be retracted out of the frame, and a moveable latch mounted within the frame to selectively engage and disengage the second portion of the bolt, the second portion being biased into an extended position and one of the first portion and second portion having a cut-out and the other having a complementary shape so as to permit the second portion to fold back onto the first portion when retracted out of the frame to permit opening of the door; and remotely disengaging the latch from the second portion of the bolt to retract the second portion of the bolt from the frame.

* * * * *